US009321277B2

(12) United States Patent
Nemoto et al.

(10) Patent No.: US 9,321,277 B2
(45) Date of Patent: Apr. 26, 2016

(54) IMAGE FORMING METHOD AND IMAGE FORMING APPARATUS

(71) Applicant: Kabushiki Kaisha Toshiba, Minato-ku (JP)

(72) Inventors: Nobuki Nemoto, Kawasaki (JP); Fumitoshi Morimoto, Shirakawa (JP); Takahisa Nakano, Kawasaki (JP); Takashi Yamaguchi, Kawasaki (JP); Shota Kure, Kawasaki (JP); Takeo Miki, Tokyo (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/628,512

(22) Filed: Feb. 23, 2015

(65) Prior Publication Data

US 2015/0258808 A1 Sep. 17, 2015

(30) Foreign Application Priority Data

Mar. 13, 2014 (JP) ..... 2014-049762

(51) Int. Cl.

| | |
|---|---|
| ***B41J 2/315*** | (2006.01) |
| ***B41J 2/32*** | (2006.01) |
| ***B41M 3/00*** | (2006.01) |
| ***B41M 3/14*** | (2006.01) |
| ***B41J 3/44*** | (2006.01) |
| ***B42D 25/30*** | (2014.01) |

(Continued)

(52) U.S. Cl.

CPC .... *B41J 2/32* (2013.01); *B41J 3/44* (2013.01); *B41M 3/008* (2013.01); *B41M 3/14* (2013.01); *B42D 25/00* (2014.10); *B42D 25/30* (2014.10); *B42D 25/45* (2014.10)

(58) Field of Classification Search

USPC ..... 347/171, 224, 232, 262, 264; 283/77, 283/67, 904; 428/172, 195.1, 204; 219/121.72

See application file for complete search history.

(56) References Cited

U.S. PATENT DOCUMENTS

| | | | |
|---|---|---|---|
| 5,350,198 | A | 9/1994 | Bernecker |
| 5,435,599 | A | 7/1995 | Bernecker |
| 5,774,168 | A | 6/1998 | Blome |

(Continued)

FOREIGN PATENT DOCUMENTS

| | | | |
|---|---|---|---|
| EP | 2 463 109 | A1 | 6/2012 |
| EP | 2 730 425 | A1 | 5/2014 |

(Continued)

OTHER PUBLICATIONS

Extended European Search Report issued Jul. 17, 2015 in Patent Application No. 15154104.2.

*Primary Examiner* — Kristal Feggins

(74) *Attorney, Agent, or Firm* — Oblon, McClelland, Maier & Neustadt, L.L.P

(57) ABSTRACT

According to one embodiment, an image forming method includes recording in a first recording portion, on a first member of a data recording medium, a first portion of an image to be recorded in the data recording medium; recording, in a second recording portion, a second portion of the image on a bonding surface to be bonded to the first member, of a second member of the data recording medium which is to be bonded to the first member and covers the first portion of the image that has been recorded on the first member; combining the second portion of the image with the first portion of the image to form the image; and bonding the second member to the first member.

10 Claims, 7 Drawing Sheets

(51) Int. Cl.
*B42D 25/00* (2014.01)
*B42D 25/45* (2014.01)

(56) References Cited

U.S. PATENT DOCUMENTS

| | | | | |
|---|---|---|---|---|
| 2010/0260985 | A1 | 10/2010 | Hagemann et al. | |
| 2010/0304093 | A1* | 12/2010 | Hagemann et al. | 428/172 |
| 2013/0235145 | A1 | 9/2013 | Geuens et al. | |

FOREIGN PATENT DOCUMENTS

| | | | |
|---|---|---|---|
| JP | 4715160 | | 7/2011 |
| WO | WO 2009/071067 | A2 | 6/2009 |
| WO | WO 2009/071067 | A3 | 6/2009 |
| WO | WO 2009/071067 | A9 | 6/2009 |
| WO | WO 2009/071068 | A2 | 6/2009 |
| WO | WO 2009/071068 | A3 | 6/2009 |

* cited by examiner

| COMBINATION | FIRST IMAGE DATA | SECOND IMAGE DATA |
|---|---|---|
| 1 | CMY | K |
| 2 | CMK | Y |
| 3 | CYK | M |
| 4 | MYK | C |
| 5 | CM | YK |
| 6 | CY | MK |
| 7 | MY | CK |
| 8 | CK | MY |
| 9 | MK | CY |
| 10 | YK | CM |
| 11 | C | MYK |
| 12 | M | CYK |
| 13 | Y | CMK |
| 14 | K | CMY |

FIG. 8

IMAGE FORMING METHOD AND IMAGE FORMING APPARATUS

CROSS-REFERENCE TO RELATED APPLICATION

This application is based upon and claims the benefit of priority from Japanese Patent Application No. 2014-049762, filed on Mar. 13, 2014; the entire contents of which are incorporated herein by reference.

FIELD

Embodiments described herein relate generally to an image forming method and an image forming apparatus.

BACKGROUND

Regarding a data recording medium such as an ID card, it is likely that a forged article is manufactured, or alteration is made by rewriting data such as a photograph and a full name. In order to prevent the forgery/alteration like this, a protection film to which a forgery/alteration prevention technology such as a hologram is applied may be pasted on a data recording medium.

For example, there is a possibility that forgery/alteration is made wherein a protection film is separated from a data recording medium, and one of the protection film and the data recording medium is reused.

BRIEF DESCRIPTION OF THE DRAWINGS

FIG. 8 is a table showing C M Y K components included in the first and second image data of the third embodiment.

DETAILED DESCRIPTION

According to one embodiment, there is provided an image forming method including: recording in a first recording portion, on a first member of a data recording medium, a first portion of an image to be recorded in the data recording medium; recording, in a second recording portion, a second portion of the image on a bonding surface to be bonded to the first member, of a second member of the data recording medium which is to be bonded to the first member and covers the first portion of the image that has been recorded on the first member; combining the second portion of the image with the first portion of the image to form the image; and bonding the second member to the first member.

Further, according to one embodiment, there is provided an image forming apparatus including a first recording portion to record, on a first member of a data recording medium, a first portion of an image to be recorded in the data recording medium; a second recording portion to record a second portion of the image on a bonding surface to be bonded to the first member, of a second member of the data recording medium which is to be bonded to the first member and covers the first portion of the image that has been recorded on the first member; the second portion of the image being combined with the first portion of the image to form the image; and a bonding portion to bond the second member to the first member.

Figure 1:
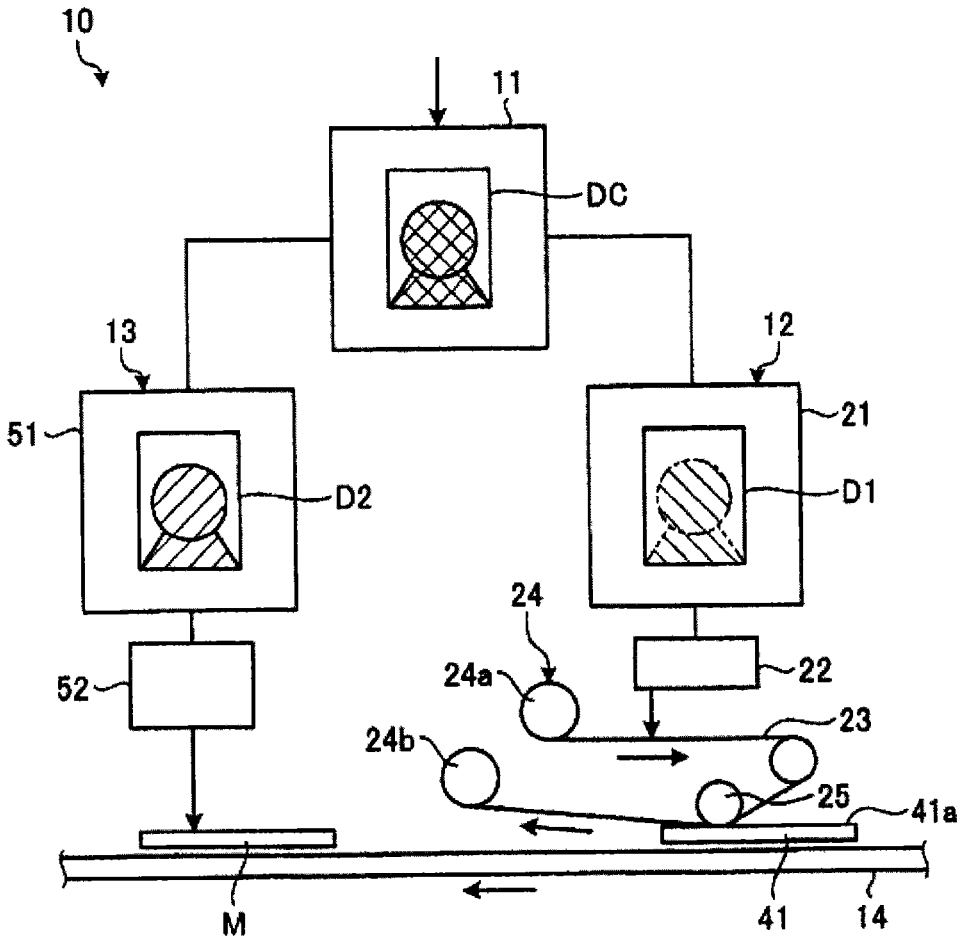
FIG. 1 is a diagram showing an ID card manufacturing device according to a first embodiment.
Figure 2:
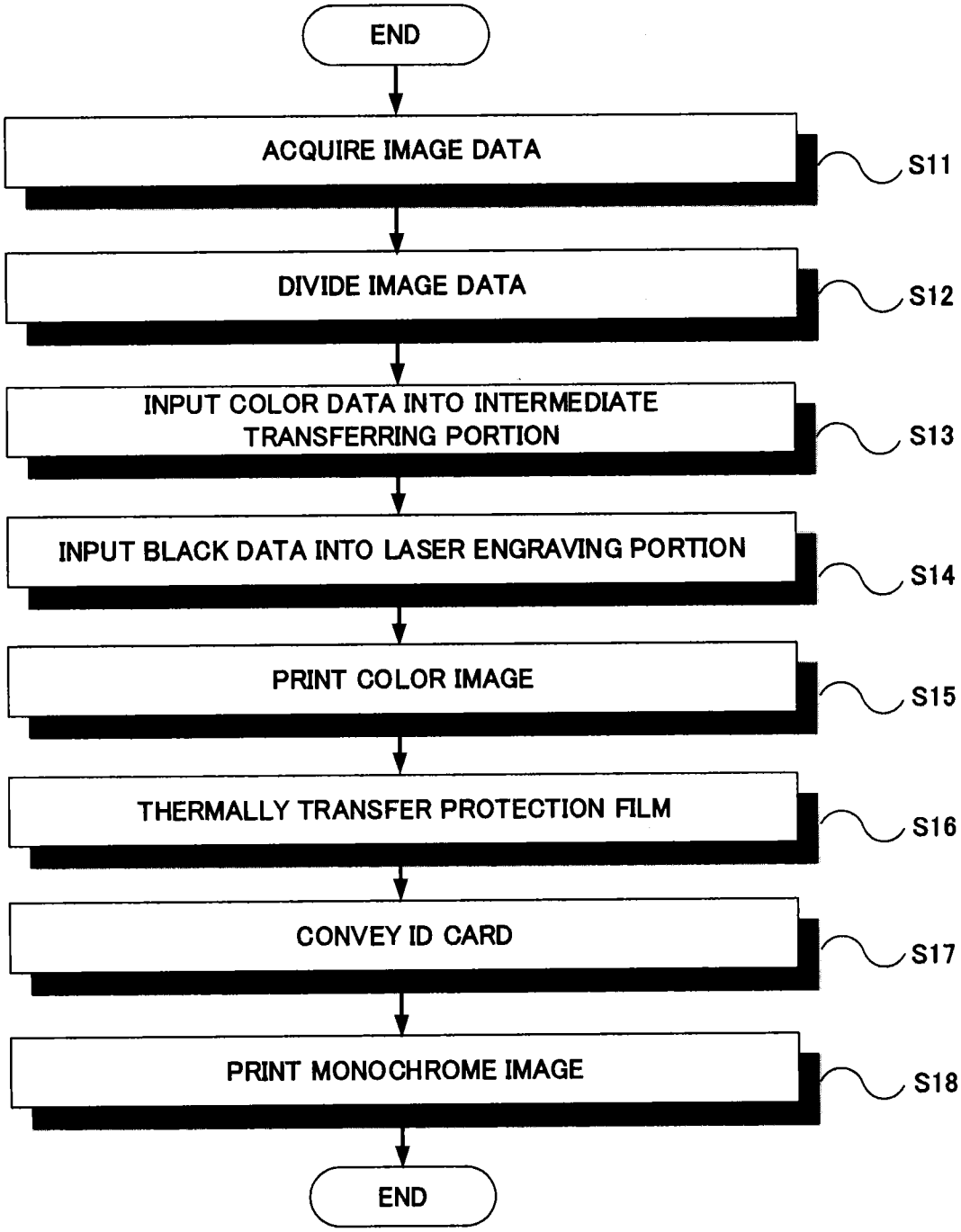
FIG. 2 is a flow chart showing a manufacturing method of the ID card of the first embodiment.

Hereinafter, a first embodiment will be described with reference to FIG. 1 to FIG. 4. In addition, with respect to a constituent element according to the embodiment, and the description of the relevant element, a plurality of wordings may be written together. With respect to the relevant constituent element and the description thereof, it shall not be hindered that other wordings which are not described may be made. Further, with respect to a constituent element and the description thereof which are not described using a plurality of wordings, it shall not be hindered that other wordings may be made. FIG. 1 is a diagram schematically showing an ID card manufacturing device 10 according to a first embodiment. FIG. 2 is a flow chart showing an example of an ID card manufacturing method. The ID card manufacturing device 10 is an example of an image forming apparatus. The ID card manufacturing device 10 manufactures an ID card M. The ID card M is an example of a data recording medium, and is one of various data recording mediums, such as a driver's license, a passport, and a visa (visa). In addition, the data recording medium is not limited to this.

As shown in FIG. 1, the ID card manufacturing device 10 has an image processing portion 11, an intermediate transferring portion 12, a laser engraving portion 13, a conveying portion 14. The image processing portion 11 can also be referred to as a controller, for example. The intermediate transferring portion 12 is an example of a second recording portion. The laser engraving portion 13 is an example of a first recording portion. Each of the intermediate transferring portion 12 and the laser engraving portion 13 can also be referred to as a recording portion, a printing portion, or an image forming portion.

Image data DC to be printed to the ID card M is inputted to the image processing portion 11 (step S11). The image data DC is data of a color image, and is a face photograph, for example. In addition, the image data DC may be data of a monochrome image.

The image processing portion 11 divides the image data DC into color data D1 and black data D2 (step S12). The color data D1 is an example of data of a second portion of the image. The black data D2 is an example of data of a first portion of the image.

Specifically, the image processing portion 11 decomposes the image data DC into respective color components of cyan (C), magenta (M), yellow (y), and black (K), with an error diffusion method, for example. For example, the image processing portion 11 calculates respective values of C, M and Y components, for each pixel (dot) of the image data DC. The image processing portion 11 makes a minimum value of the relevant C, M, and Y components to be a value of the K component. Further, the image processing portion 11 subtracts the value of the K component from the values of the C, M, and Y components, and makes the obtained values to be values of the C, M, Y components, respectively. In this manner, the image processing portion 11 calculates the values of C, M, Y and K components for each dot.

The image processing portion 11 may decompose the image data DC with another method different from an error diffusion method. In addition, the image processing portion 11 may decompose the image data DC into a plurality of color components containing other color components (light cyan, light magenta, white color, and fluorescent color, for example).

The image processing portion 11 generates the color data D1 from the C, M, and Y components of the image data DC. That is, the color data D1 is data of an image containing only the C, M, and Y components. In other words, the color data D1 is data of an image which is obtained by eliminating the K components from the image data DC.

The image processing portion 11 generates the black data D2 from the K components of the image data DC. That is, the black data D2 is data of an image containing only the K components. In other words, the black data D2 is data of an image which is obtained by eliminating the C, M, and Y components from the image data DC.

The color data D1 and the black data D2 are synthesized (overlapped), to form the original image data DC. In addition, the image processing portion 11 may divide the image data DC into not less than three data, according to colors, or may divide the image data DC for each position (coordinate).

The image processing portion 11 inputs the color data D1 into the intermediate transferring portion 12 (step S13). In addition, the image processing portion 11 inputs the black data D2 into the laser engraving portion 13 (step S14). Further, the intermediate transferring portion 12 and the laser engraving portion 13 may generate the color data D1 and the black data D2 from the image data DC, respectively.

The intermediate transferring portion 12 has a first memory 21, an ink jet head 22, an intermediate transfer medium 23, a medium conveying portion 24, a heat roller 25. The intermediate transfer medium 23 can also be referred to as a medium, a member, or a portion. The heat roller 25 is an example of a bonding portion. The bonding portion is not limited to this, but may be another component such as a thermal head.

The first memory 21 stores the color data D1 inputted from the image processing portion 11. The ink jet head 22 acquires, from the first memory 21, the color data D1 which has been stored in the relevant first memory 21.

The intermediate transfer medium 23 is formed in a belt shape. One end portion of the intermediate transfer medium 23 is wound around a feeding roller 24*a* of the medium conveying portion 24. The other end portion of the intermediate transfer medium 23 is fitted to a winding roller 24*b* of the medium conveying portion 24. The winding roller 24*b* rotates, to cause the intermediate transfer medium 23 to be conveyed from the feeding roller 24*a* toward the winding roller 24*b*.

Figure 3:
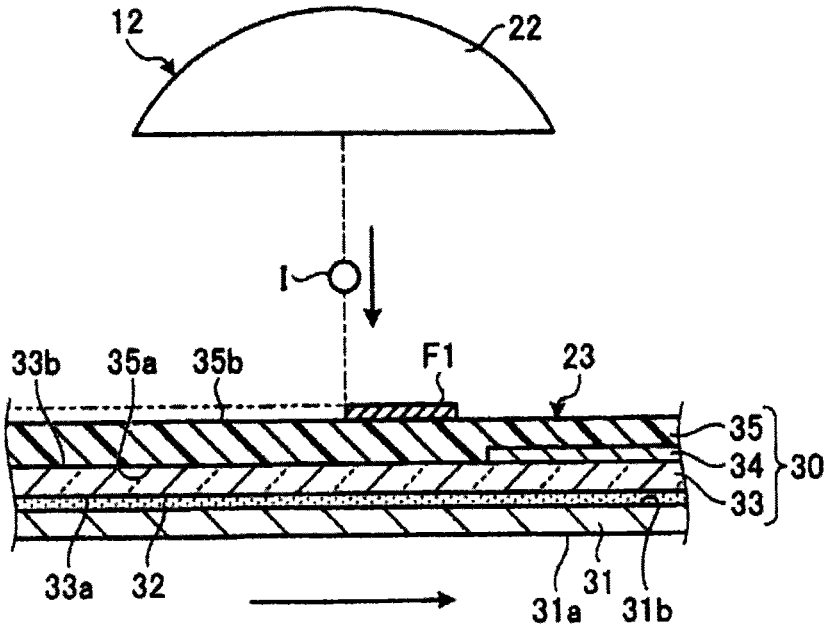
FIG. 3 is a sectional view showing a part of the intermediate transferring portion of the first embodiment.

FIG. 3 is a sectional view showing a part of the intermediate transferring portion 12. As shown in FIG. 3, the intermediate transfer medium 23 has a protection film 30, a base layer 31, a separation layer 32. The protection film 30 can also be referred to as a protection portion, a protection film, a medium, a member, or a portion. The protection film 30 has a protection layer 33, a plurality of functional layers 34, an adhesion layer 35. The adhesion layer 35 is an example of a second member, and can also be referred to as an ink image receiving layer, a printing layer, or an image forming layer.

The base layer 31 is formed of polyethylene terephthalate, for example. In addition, the base layer 31 may be formed of other material such as polyester or polyacryl. The base layer 31 has a first surface 31*a* and a second surface 31*b*. The first surface 31*a* forms one surface of the intermediate transfer medium 23. The second surface 31*b* is located at the opposite side of the first surface 31*a*.

The separation layer 32 is formed of synthetic resin, for example, and covers the second surface 31*b* of the base layer 31. The separation layer 32 holds the protection film 30 in the state that the protection film 30 is separable from the base layer 31. For example, the separation layer 32 makes the protection film 30 firmly adhere to the base layer 31, and when being heated at not less than a prescribed temperature, the separation layer 32 melts, to make the protection film 30 separable from the base layer 31.

The protection layer 33 is formed of transparent or light transmissive synthetic resin such as polypropylene. In addition, the protection layer 33 may be formed of other material. The protection layer 33 has a first surface 33*a* and a second surface 33*b*. The first surface 33*a* is held to the base layer 31 by the separation layer 32. The second surface is located at the opposite side of the first surface 33*a*.

The functional layer 34 is a hologram, for example. In addition, the functional layer 34 is not limited to this. The functional layer 34 is provided for preventing forgery/alteration. The functional layer 34 is formed on the second surface 33*b* of the protection layer 33. A plurality of the functional layers 34 are arranged at prescribed intervals in the longitudinal direction of the belt-like intermediate transfer medium 23. In addition, the protection film does not have to be provided with the functional layer 34.

The adhesion layer 35 is formed of transparent or light transmissive synthetic resin, for example. The material of the adhesion layer 35 is composed of 70% modified polyester resin, 1% polyoxyalkylene lauryl ether, 9% cationic vinyl compound copolymer, and 20% vinyl acetate.maleate copolymer, for example. In addition, the material, component, and composition of the adhesion layer 35 are not limited to these.

The adhesion layer 35 covers the second surface 33*b* of the protection layer 33, and the function layer 34 provided on the second surface 33*b*. When being heated at not less than a definite temperature, the adhesion layer 35 melts and adheres to other object. Further, it is possible to form an image on the adhesion layer 35, with ink jet printing using aqueous ink, and the fixation of the formed image is good. In addition, it may be possible to form an image on the adhesion layer 35, with other substance such as oil ink, and with other method.

The adhesion layer 35 has a first surface 35*a* and a second surface 35*b*. The second surface 35*b* is an example of a bonding surface. The first surface 35*a* firmly adheres to the second surface 33*b* of the protection layer 33, and the functional layer 34. The second surface 35*b* is located at the opposite side of the first surface 35*a*. The second surface 35*b* forms the other surface of the intermediate transfer medium 23.

The protection layer 33 and the adhesion layer 35 of the protection film 30 transmit ultraviolet light, visible light, and near infrared light of at least 200 nm-2000 nm. In addition, the functional layer 34 may also transmit the relevant ultraviolet light, visible light, and near infrared light.

The ink jet head 22 prints a color image F1 on the second surface 35*b* of the adhesion layer 35 with an ink jet system (step S15). The color image F1 is an example of the second portion of the image. The color image F1 which the ink jet head 22 prints is an image which is obtained by mirror reversing the image relating to the color data D1. When visually recognized from the first surface 33*a* side of the protection layer 33, for example, the color image F1 coincides with the image relating to the color data D1.

The ink jet head 22 discharges inks I of C, M, and Y toward the second surface 35*b* of the adhesion layer 35 facing to the ink jet head 22. By this means, the ink jet head 22 forms dots of C, M, and Y components on the second surface 35*b* of the adhesion layer 35. The color image F1 is formed with the relevant dots. In addition, FIG. 3 shows an unformed portion of the color image F1 by a chain double-dashed line.

The medium conveying portion 24 conveys the intermediate transfer medium 23 with suction belt conveying, for example, at the position where the ink jet head 22 prints to the intermediate transfer medium 23. By this means, the medium conveying portion 24 keeps constant the distance between the intermediate transfer medium 23 and the ink jet head 22.

As shown in FIG. 1, the conveying portion 14 conveys a base material 41 that is a part of the ID card M. The base material 41 is an example of a first member, and can also be referred to as a medium or a portion. The conveying portion 14 conveys the base material 41 with roller conveying or belt conveying, for example.

The base material 41 is formed of polycarbonate containing material (hereinafter, referred to as laser coloring material) which absorbs laser light and develops color. In addition, the base material is not limited to this, but may be formed of plastics such as polyethylene terephthalate, polyacryl, and polyvinyl acetate, or other material such as a paper with a surface on which a layer of laser coloring material is formed.

The conveying portion 14 conveys the base material 41 immediately below the heat roller 25 of the intermediate transferring portion 12. On the other hand, the intermediate transfer medium 23 on which the color image F1 has been formed by the ink jet head 22 is conveyed between the heat roller 25 and the base material 41 by the medium conveying portion 24.

The heat roller 25 is heated to a temperature between 120° C.-200° C., for example. In addition, without being limited to this, the heat roller 25 may be heated to a temperature between 80° C.-250° C., for example. The heat roller 25 thermally transfers the protection film 30 of the intermediate transfer medium 23 to the base material 41 (step S16).

The heat roller 25 heats the intermediate transfer medium 23, and thereby the second surface 35*b* of the adhesion layer 35 is bonded to the base material 41. Further, the separation layer 32 separates the protection film 30 from the base layer 31. By this means, the protection film 30 is bonded to the base material 41, and thereby the ID card M is formed. When the protection film 30 is bonded to the base material 41, the first surface 33*a* of the protection layer 33 forms a surface of the ID card M. The base layer 31 from which the protection film 30 has been separated is conveyed toward the winding roller 24*b* by the medium conveying portion 24.

Since the temperature of the heat roller 25 is not less than 80° C., the adhesion layer 35 is firmly bonded to the base material 41. Since the temperature of the heat roller 25 is not more than 250° C., the intermediate transfer medium 23 and the base member 41 are suppressed from being thermally broken down.

Figure 4:
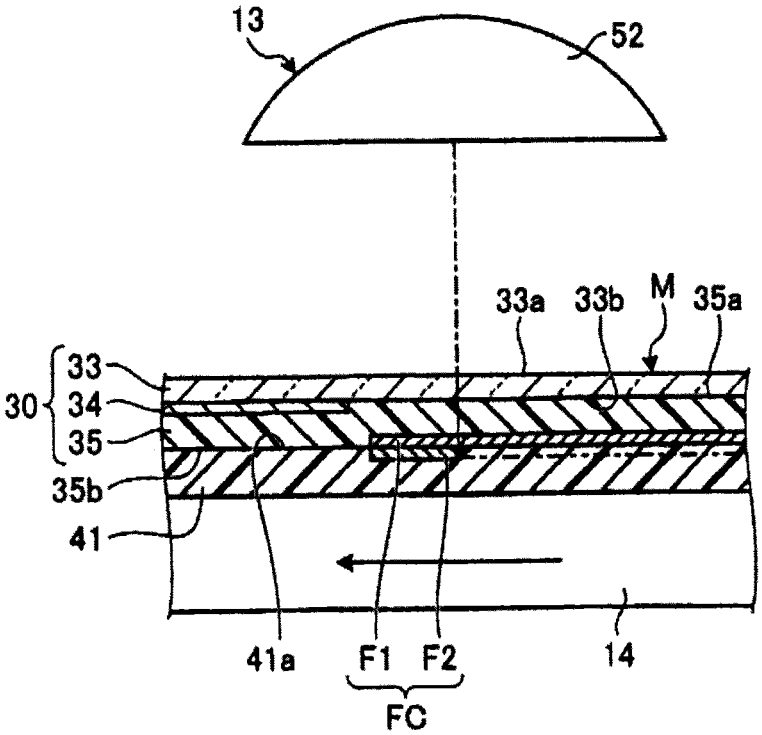
FIG. 4 is a sectional view showing a part of the laser engraving portion of the first embodiment.

FIG. 4 is a sectional view showing a part of the laser engraving portion 13. As shown in FIG. 4, the base material 41 (the ID card M) to which the protection film 30 has been bonded by the intermediate transferring portion 12 is conveyed immediately below the laser engraving portion 13 by the conveying portion 14 (step S17).

The laser engraving portion 13 forms a monochrome image F2 at a coloring surface 41*a* of the base material 41 with a laser engraving system (step S18). The monochrome image F2 is an example of the first portion of the image.

The coloring surface 41*a* of the base material 41 is a surface of the base material 41 to which the adhesion layer 35 of the protection film 30 has been bonded. When the base material 41 is formed of paper, for example, the coloring surface 41*a* is formed of a layer of laser coloring material formed on the relevant paper. The coloring surface 41*a* is covered with the protection film 30.

A laser engraving system is a method to form an image by irradiating laser coloring material with laser light. The laser engraving system can generally form an image with higher resolution than an ink jet system, for example. A color which the laser coloring material develops is mainly a black color.

As shown in FIG. 1, the laser engraving portion 13 has a second memory portion 51 and a laser irradiating portion 52. The second memory portion 51 stores the black data D2 inputted from the image processing portion 11. The laser irradiating portion 52 acquires, from the second memory portion 51, the black data D2 stored in the relevant second memory portion 51.

The laser irradiating portion 52 uses a YAG laser or a diode laser with a wavelength of 900 nm-1600 nm. In addition, the laser irradiating portion 52 may use other laser. As shown in FIG. 4, the laser irradiating portion 52 irradiates laser light toward the first surface 33*a* of the protection layer 33 which forms the surface of the ID card M.

The laser light which the laser irradiating portion 52 has irradiated passes through the protection layer 33, the adhesion layer 35, and the color image F1, and is absorbed by the coloring surface 41*a* of the base material 41. That is, the laser irradiating portion 52 irradiates the coloring surface 41*a* of the base material 41 with the laser light.

The portion of the coloring surface 41*a* which has been irradiated with the laser light develops black color, for example. The laser irradiating portion 52 irradiates the coloring surface 41*a* with the laser light, to form a dot of the K component. The monochrome image F2 is formed with the dots of the relevant K component. In addition, FIG. 4 shows an unformed portion of the monochrome image F2 by a chain double-dashed line.

The monochrome image F2 formed at the coloring surface 41*a* of the base material 41 is covered with the adhesion layer 35. The color image F1 is located at the portion of the adhesion layer 35 which covers the monochrome image F2. In other words, the laser irradiating portion 52 irradiates the position where the color image F1 has been formed with laser light, to form the monochrome image F2. The formed color image F1 and the monochrome image F2 are overlapped with each other.

The second surface 35*b* of the adhesion layer 35 is bonded to the base material 41, and thereby the first surface 33*a* of the protection layer 33 forms the surface of the ID card M. For this reason, the color image F1 displayed in the ID card M is inverted, and the inverted color image F1 coincides with the image relating to the color data D1. That is, the color image F1 coincident with the color data D1, and the monochrome image F2 coincident with the black data D2 are overlapped with each other. For this reason, the overlapped color image F1 and monochrome image F2 form an image FC coincident with the image data DC.

As described above, the color image F1 and the monochrome image F2 are combined, to form the image FC. For this reason, the image FC has the dots of the C, M and Y components contained in the color image F1, and the dots of the K component contained in the monochrome image F2. That is, the image FC is a color image containing the C, M, Y, and K components.

When the laser engraving portion 13 forms the monochrome image F2, alignment of the ID card M is performed. The laser irradiating portion 52 detects a marking portion contained in the color image F1, to perform the relevant alignment.

The ink jet head 22 forms a part of the black portion of the image FC, for example, with the dots of the C, M, and Y components. The laser irradiating portion 52 detects the relevant black portion (marking portion) with a camera, for example. The laser irradiating portion 52 forms the monochrome image F2, using the relevant black portion as a reference. By this means, the color image F1 and the monochrome image F2 are suppressed from being out of alignment. when the monochrome image F2 is formed, the relevant black portion becomes inconspicuous.

The alignment of the ID card M is not limited to the above-described method. For example, the alignment of the ID cared M may be performed by that the camera of the laser irradiating portion 52 detects an edge or a corner of the color image F1, or may be performed by a stage or a table installed on the conveying portion 14.

Further, a marking may be made on a portion of the intermediate transfer medium 23 where thermal transferring is not performed to the ID card M. For example, after the monochrome image F2 has been formed based on the relevant marking, the relevant marked portion may be separated from the ID card M.

The ID card with the image FC which has been formed as described above is conveyed by the conveying portion 14. The ID cared M is carried out outside the ID card manufacturing device 10, and is delivered.

In the ID card manufacturing device 10 according to the first embodiment, the laser engraving portion 13 forms the monochrome image F2 on the base material 41. Further, the intermediate transferring portion 12 forms the color image F1 on the second surface 35*b* of the adhesion layer 35. In this manner, since parts (the color image F1 and the monochrome image F2) of the image FC are formed on both of the base material 41 and the adhesion layer 35, even if the protection film 30 is separated from the base material 41, the respective parts of the image FC remain on both of the protection film 30 and the base material 41. For this reason, the ID card M is suppressed from being forged/altered by reusing one of the base material 41 and the protection film 30.

The color image F1 is printed on the second surface 35*b* of the adhesion layer 35, and is covered with the protection layer 33. In other words, the color image F1 is located inside the ID card M. For this reason, even if disinformation is printed on the surface (the first surface 33*a* of the protection layer 33) of the ID card M, and the image FC is hidden with the relevant disinformation, it is possible to immediately discriminate the forgery/alteration like this.

The image processing portion 11 divides the image data DC for respective colors, to generate the color data D1 and the black data D2. For the reason, it is not until the color image F1 relating to the color data D1 is combined with the monochrome image F2 relating to the black data D2 that they make a sense as the image FC. By means of this, the ID card M is suppressed from being forged/altered by reusing one of the base material 41 and the protection film 30.

The monochrome image F2 is recorded with a laser engraving system. By means of this, it is possible to form the monochrome image F2 at high speed and with high resolution. Further, since it is possible to discriminate whether or not the relevant image is an image formed with a laser engraving system, by means of the optical means such as a microscope, for example, it is possible to easily discriminate the forgery/alteration of the ID card M using black ink, for example.

The laser irradiating portion 52 irradiates laser light which passes through the protection film 30. And, the laser engraving portion 13 irradiates the base material 41 covered with the protection film 30 on which the color image F1 has been formed with the above-described laser light, to form the monochrome image F2. That is, since the monochrome image F2 is formed in the state in which the color image F1 has been formed, it is possible to suppress that the position displacement between the color image F1 and the monochrome image F2 caused by sticking them occurs, and it is possible to form the image FC with good image quality.

The image processing portion 11 generates the color data D1 and the black data D2 with an error diffusion method. A laser engraving system generally forms an image in the pseudo gradation expression processed with an error diffusion method. For this reason, the color data D1 and the black data D2 are both generated with an error diffusion method, and thereby the color image F1 and the monochrome image F2 are combined in a good manner, and it is possible to form the image FC with good image quality. In addition, the image processing portion 11 may generate the color data D1 and the black data D2 with a multi-valued error diffusion method of several levels, to make each of the pixels have a gradation.

Further, the program to be executed in the ID card manufacturing device 10 of the present embodiment is presented with being incorporated previously in a ROM and so on. The relevant program may be configured such that the program is presented with being stored in a computer readable recording medium, such as a CD-ROM, a flexible disk (FD), a CD-R, a DVD (Digital Versatile Disk) in a file form of an installable format or an executable format.

Further, the program to be executed in the ID card manufacturing device 10 of the present embodiment may be configured such that the program is stored on a computer connected to a network such as Internet, and is presented by being downloaded through the network. In addition, the program to be executed in the ID card manufacturing device 10 of the present embodiment may be configured such that the program is provided or distributed through a network such as Internet.

The program to be executed in the ID card manufacturing device 10 of the present embodiment is composed of a module configuration including a portion to generate the color data D1 and the black data D2 from the image data DC, and other various portions. And an actual hardware is configured such that a CPU (processor) reads the program from the above-described ROM and executes the program, and the above-described respective portions are loaded on a main storage device, and are generated on the main memory device.

Hereinafter, a second embodiment will be described with reference to FIG. 5 and FIG. 6. In addition, in the description of a plurality of following embodiments, to constituent elements having the same functions as the previously described constituent elements, the same symbols as the relevant previously described constituent elements are given, and further description may be omitted. In addition, in a plurality of the constituent elements to which the same symbols are given, the all functions and properties are not necessarily common, and the constituent elements may have different functions and properties in accordance with the respective embodiments.

Figure 5:
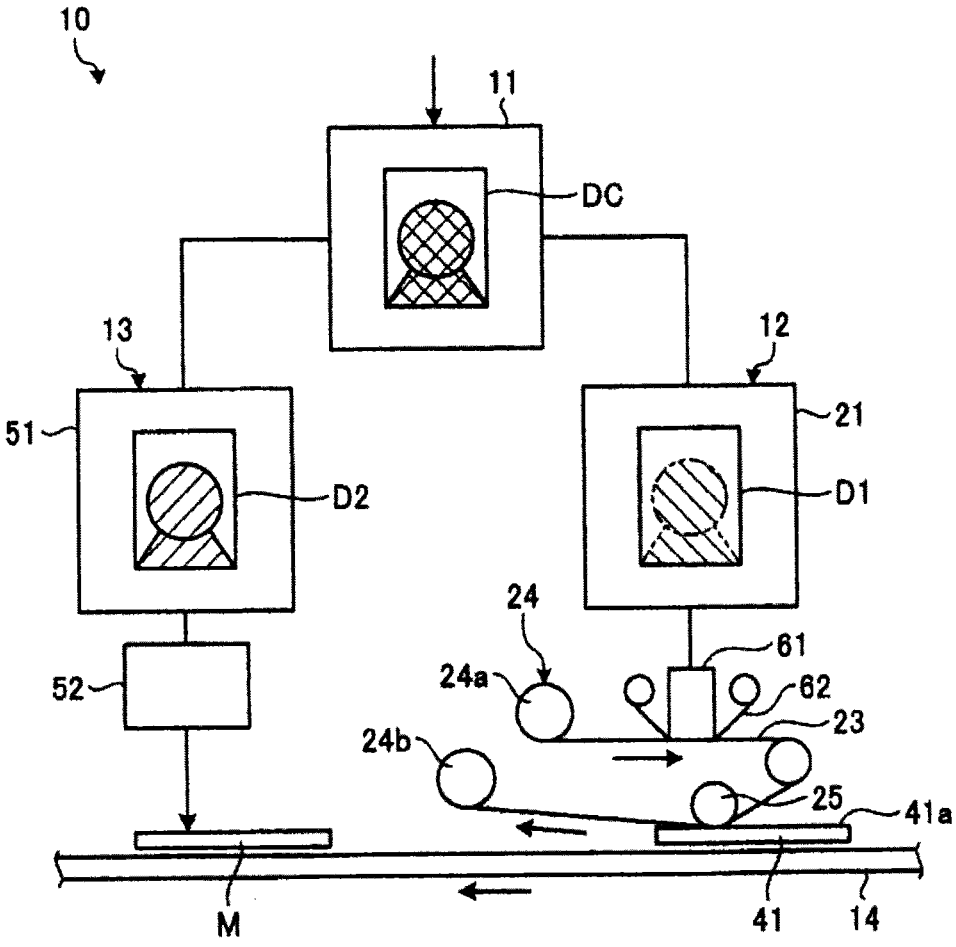
FIG. 5 is a diagram showing an ID card manufacturing device according to a second embodiment.

FIG. 5 is a diagram schematically showing an ID card manufacturing device 10 according to a second embodiment. As shown in FIG. 5, the intermediate transferring portion 12 of the second embodiment has a thermal head 61 and ink ribbon 62, in place of the ink jet head 22.

The thermal head 61 thermally transfers ink of the ink ribbon 62 to the second surface 35*b* of the adhesion layer 35. Inks of C, M, and Y are applied to the ink ribbon 62, so that they are lined in order. The ink ribbon 62 reciprocates below the thermal head 61, and thereby the color image F1 is formed.

Figure 6:
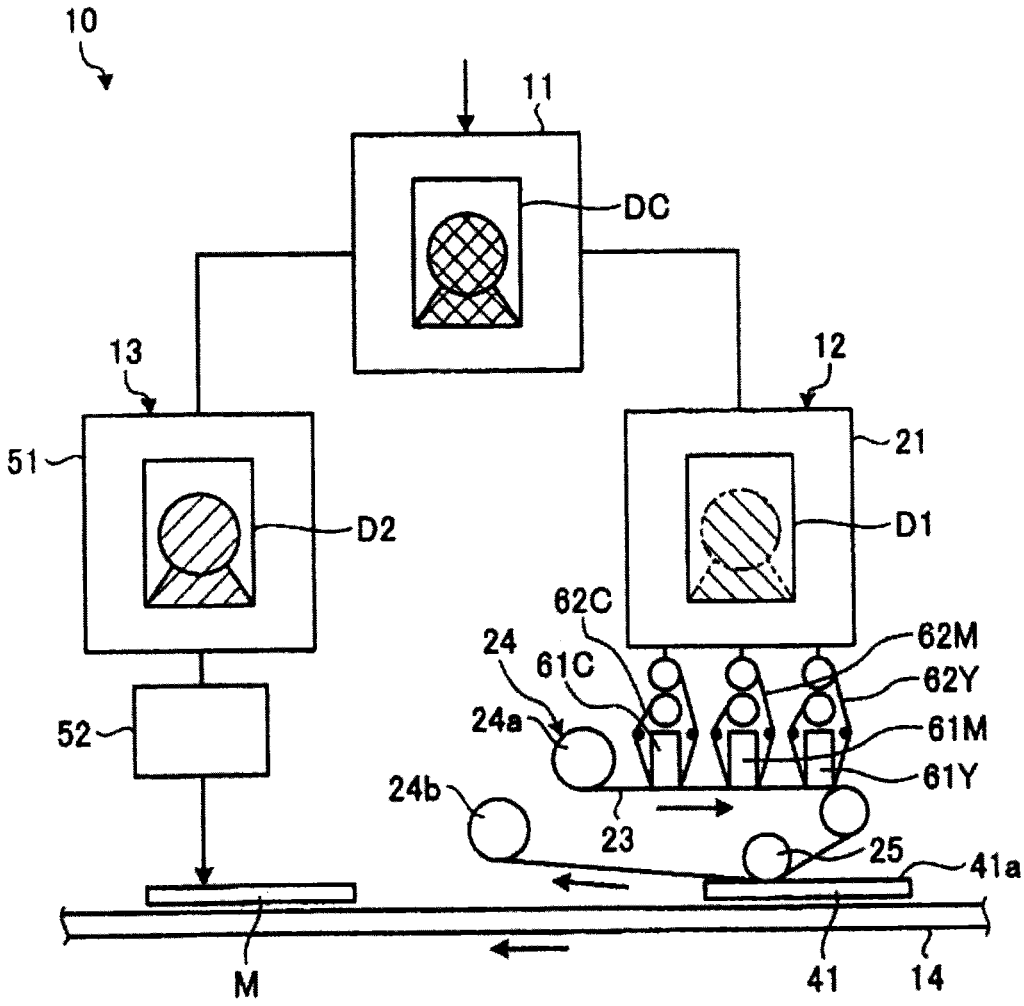
FIG. 6 is a diagram showing a modification of the ID card manufacturing device of the second embodiment.

FIG. 6 is a diagram schematically showing a modification of the ID card manufacturing device 10 of the second embodiment. As shown in FIG. 6, the intermediate transferring portion 12 may have a plurality of thermal heads 61C, 61M, 61Y and a plurality of ink ribbons 62C, 62M, 62Y.

The thermal head 61C forms the C component of the color image F1 on the second surface 35*b* of the adhesion layer 35, using the ink ribbon 62C to which the ink of C is applied. The thermal head 61M forms the M component of the color image F1 on the second surface 35*b* of the adhesion layer 35, using the ink ribbon 62M to which the ink of M is applied. The thermal head 61Y forms the Y component of the color image F1 on the second surface 35*b* of the adhesion layer 35, using the ink ribbon 62Y to which the ink of Y is applied. In this manner, the color image F1 is formed on the second surface 35*b* of the adhesion layer 35, by the three thermal heads 61C, 61M, 61Y.

As shown in the above-described second embodiment, the color image F1 to be formed on the second surface 35*b* of the adhesion layer 35 may be formed with a thermal transfer system. In this manner, the color image F1 is not only formed with the ink jet system of the first embodiment, but may be formed with the thermal transfer system of the second embodiment, or other systems.

Figure 7:
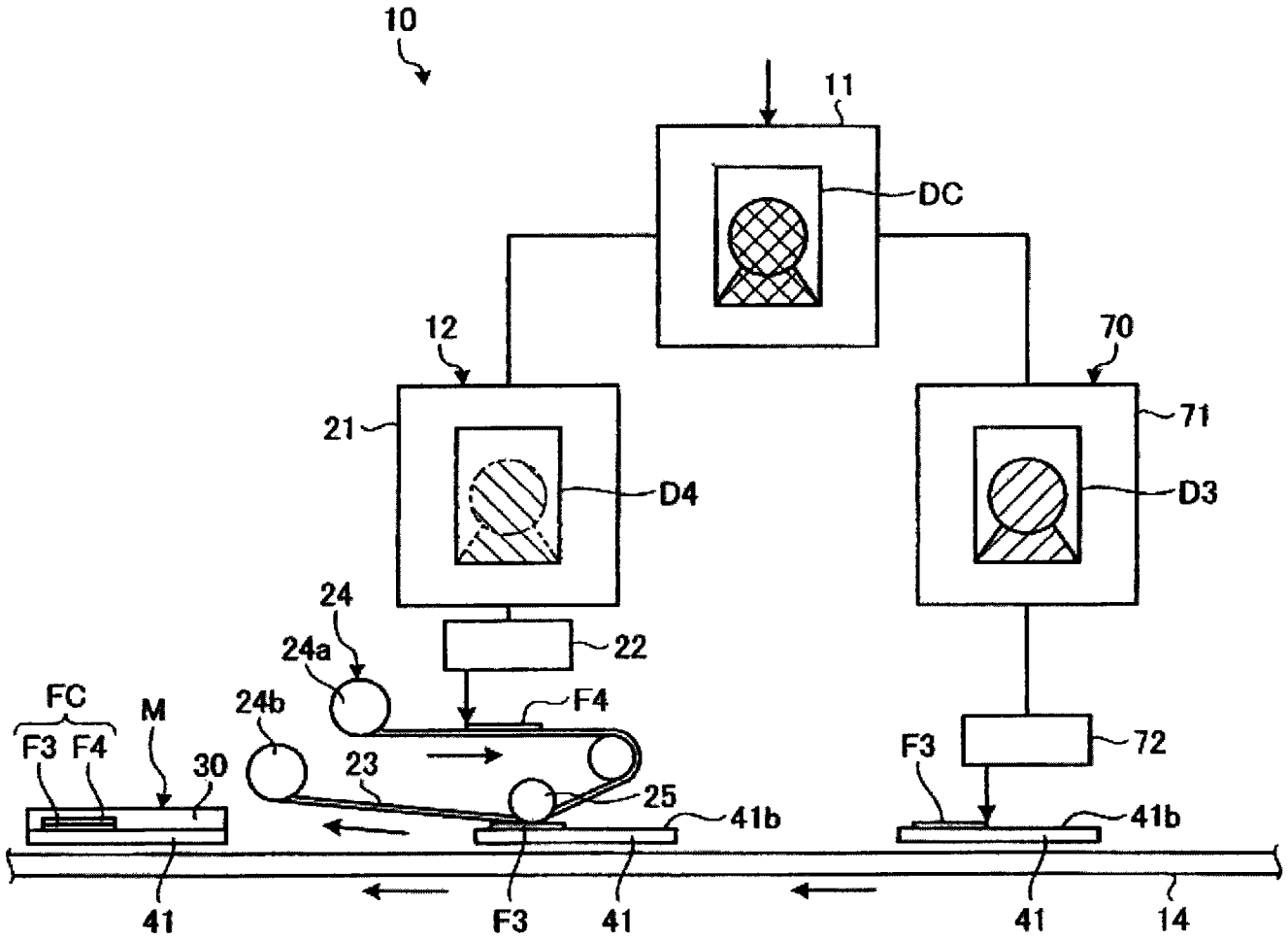
FIG. 7 is a diagram showing an ID card manufacturing device according to a third embodiment.

Hereinafter, a third embodiment will be described with reference to FIG. 7 and FIG. 8. FIG. 7 is a diagram schematically showing the ID card manufacturing device 10 according to the third embodiment. As shown in FIG. 7, the ID card manufacturing device 10 of the third embodiment has an ink jet printing portion 70 in place of the laser engraving portion 13. The ink jet printing portion 70 is an example of the first recording portion.

The image processing portion 11 divides the image data DC into first image data D3 and second image data D4. The first image data D3 is an example of the data of the first portion of the image. The second image data D4 is an example of the data of the second portion of the image.

Specifically, the image processing portion 11 decomposes the image data DC into the C, M, Y, and K components, in the same manner as the first embodiment. The image processing portion 11 generates the first image data D3 and the second image data D4, from the relevant C, M, Y, and K components.

FIG. 8 is a table showing the C, M, Y, and K components included in the first image data D3 and the second image data D4, As shown in FIG. 8, the first image data D3 has one to three components out of the C, M, Y, and K components of the image data DC. The second image data D4 has the remaining C, M, Y, and K components.

In the present embodiment, as shown as a combination 1 in FIG. 8, for example, the first image data D3 has the C, M, and Y components, and the second image data D4 has the K component. In addition, the first and second image data D3, D4 may be other combination. Further, the first and second image data D3, D4 may have components of other colors (light cyan, light magenta, white color, fluorescent color).

As shown in FIG. 7, the ink jet printing portion 70 is located at the upstream of the intermediate transferring portion 12 in the route of the conveying portion 14. The ink jet printing portion 70 has a third memory portion 71 and an ink jet head 72.

The third memory portion 71 is a storage device such as a RAM, for example. The image processing portion 11 inputs the generated first image data D3 into the ink jet printing portion 70, and the third memory portion 71 stores the relevant first image data D3. The ink jet head 72 acquires the first image data D3 which has been stored in the third memory portion 71.

The conveying portion 14 conveys the base material 41 of the ID cared M immediately below the ink jet head 72. The ink jet head 72 forms a first divided image F3 on a surface 41*b* of the base material 41, with an ink jet system. The first divided image F3 is an example of the first portion of the image. The base material 41 of the present embodiment, and the surface 41*b* of the base material 41 do not have to contain laser coloring material.

The ink jet head 72 discharges the black (K) ink on the surface 41*b* of the base material 41. By this means, the ink jet head 72 forms a dot of the K component on the surface 41*b* of the base material 41. The first divided image F3 is formed with the relevant dots.

The image forming portion 11 inputs the generated second image data D4 into the intermediate transferring portion 12. The first memory 21 stores the relevant second image data D4. The ink jet head 22 of the intermediate transferring portion 12 prints a second divided image F4 on the second surface 35*b* of the adhesion layer 35 of the intermediate transfer medium 23, with an ink jet system. The second divided image F4 is an example of the second portion of the image.

The second divided image F4 which the ink jet head 22 prints is an image which is obtained by mirror reversing the image relating to the second image data D4. When visually recognized from the first surface 33*a* side of the protection layer 33, for example, the second divided image F4 coincides with the image relating to the second image data D4.

The ink jet head 22 discharges inks of C, M, and Y toward the second surface 35*b* of the adhesion layer 35 facing to the ink jet head 22. By this means, the ink jet head 22 forms the second divided image F4. In addition, the colors which the ink jet heads 22, 72 respectively discharge are not limited to these colors, but the ink jet heads 22, 72 discharge inks of the C, M, Y, and K which the first and second divided images F3, F4 to be printed respectively contain.

The conveying portion 14 conveys the base material 41 on which the first divided image F3 has been formed immediately below the heat roller 25 of the intermediate transferring portion 12. On the other hand, the intermediate transfer medium 23 on which the second divided image F4 has been formed by the ink jet head 22 is conveyed between the heat roller 25 and the base material 41 by the medium conveying portion 24.

The heat roller 25 heats the intermediate transfer medium 23, and thereby the second surface 35 of the adhesion layer 35 is bonded to the surface 41*b* of the base material 41 on which the first divided image F3 has been formed. Further, the separation layer 32 separates the protection film 30 from the base layer 31. For this reason, the protection layer 30 is bonded to the base material 41, and thereby the ID card M is formed. The base layer 31 from which the protection film 30 has been separated is conveyed toward the winding roller 24*b* by the medium conveying portion 24.

The protection film 30 on which the second divided image F4 has been formed is bonded to the surface 41*b* of the base material 41 on which the first divided image F3 has been formed. By this means, the first divided image F3 and the second divided image F4 are overlapped with each other, and thereby the image FC equal to the image data DC is formed.

As shown in the above-described third embodiment, the image (the first divided image F3) may be formed with an ink jet system. In this manner, the image to be formed on the base material 41 is not only formed with the laser engraving system of the first embodiment, but may be formed with the ink jet system of the third embodiment, or with other systems.

Further, as shown in the third embodiment, the image (the first divided image F3) may be formed on the base material 41, before the protection film 30 is bonded to the base material 41. That is, regarding the bonding of the protection film 30 and the printing to the base material 41, any one of them may be performed firstly in accordance with the printing system.

According to at least one of the above described embodiments, the first recording portion forms the first portion of the image on the first member, and the second recording portion forms the second portion of the image on the bonding surface of the second member. By this means, the forgery/alteration of the data recording medium is suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the plurality of above-described embodiments, the image data DC has been divided into the two portions (the color data D1 and black data D2), and the relevant portions have been formed respectively on the two mediums (the protection film 30 and the base material 41). But, the image data DC may be divided into not less than three portions, and the relevant portions may be formed on not less than three mediums with not less than three image forming systems, respectively.

In addition, in the above-described embodiment, the color image F1 is an example of the second portion of the image, and the monochrome image F2 is an example of the first portion of the image. Without being limited to this, the first portion of the image may be a color image, the second portion of the image may be a monochrome image, and both of the first and second portions of the image may be monochrome images or color images.

What is claimed is:

1. An image forming method, comprising:

recording, in a first recording portion of an image forming apparatus, on a first member comprising a data recording medium, a first portion of an image;

recording, in a second recording portion of the image forming apparatus, a second portion of the image on a bonding surface of a second member different from the first member, the bonding surface of the second member is to be bonded to the first member and covers the first portion of the image that has been recorded on the first member;

combining the second portion of the image with the first portion of the image to form the image; and bonding the second member to the first member.

2. The method of claim 1, further comprising:

generating first data of the first portion and second data of the second portion by dividing the image for each color or each position;

inputting the first data of the first portion into the first recording portion; and inputting the second data of the second portion into the second recording portion.

3. The method of claim 2, wherein the recording in the first recording portion is performed according to a first recording method, and the recording in the second recording portion is performed according to a second recording method different from the first recording method.

4. The method of claim 3, wherein the first recording portion records the first portion of the image to the first member with laser engraving.

5. The method of claim 4, wherein the first recording portion records the first portion of the image on the first member, to which the second member has been bonded by a bonding portion, by irradiating the first member with laser light which passes through the second member.

6. An image forming apparatus, comprising:

a first recording portion to record, on a first member comprising a data recording medium, a first portion of an image;

a second recording portion to record a second portion of the image on a bonding surface of a second member different from the first member, the bonding surface of the second member is to be bonded to the first member and covers the first portion of the image that has been recorded on the first member;

the second portion of the image being combined with the first portion of the image to form the image; and a bonding portion to bond the second member to the first member.

7. The apparatus of claim 6, further comprising:

an image processing portion which divides the image for each color or each position to generate first data of the first portion and second data of the second portion, inputs the first data of the first portion into the first recording portion, and inputs the second data of the second portion into the second recording portion.

8. The apparatus of claim 7, wherein the first recording portion records the first portion to the first member according to a first recording method, and the second recording portion records the second portion to the second member according to a second recording method different from the first recording method.

9. The apparatus of claim 8, wherein the first recording portion records the first portion of the image to the first member with laser engraving.

10. The apparatus of claim 9, wherein the first recording portion records the first portion of the image on the first member, to which the second member has been bonded by the bonding portion, by irradiating the first member with laser light which passes through the second member.

* * * * *